US005313721A

United States Patent [19]

Filden

[11] Patent Number: 5,313,721

[45] Date of Patent: May 24, 1994

[54] POCKET CLIP FOR CARD CASES, IDENTIFICATION BADGES AND THE LIKE

[76] Inventor: Gerhard Filden, Kriehubergasse 31, A-1050 Vienna, Austria

[21] Appl. No.: 937,966

[22] Filed: Aug. 28, 1992

[51] Int. Cl.[5] ..... A44C 3/00

[52] U.S. Cl. ..... 40/1.6; 40/666; 24/458; 24/543

[58] Field of Search ..... 40/1.5, 1.6, 647, 648, 40/658, 666; 24/16 PB, 30.5 P, 339, 458, 543, 625

[56] References Cited

U.S. PATENT DOCUMENTS

| | | | |
|---|---|---|---|
| D. 234,204 | 1/1975 | Miller et al. | 24/543 X |
| 1,383,906 | 7/1921 | Clark et al. | 24/543 |
| 3,745,616 | 7/1973 | Batts | 24/543 |
| 3,823,443 | 7/1974 | Takabayashi | 24/543 X |
| 4,388,770 | 6/1983 | Manor | 40/1.6 |
| 4,536,924 | 8/1985 | Willoughby | 24/543 X |
| 5,027,480 | 7/1991 | Hogarth | 24/543 |

*Primary Examiner*—Brian K. Green
*Attorney, Agent, or Firm*—Herbert Dubno

[57] ABSTRACT

A clip for holding an identification card on a pocket, lapel or other piece of fabric is a clam-shell arrangement of upper and lower plastic members molded unitarily with one another via a film hinge. A tongue from the lower member projects through an opening of the upper member to form a ratchet therewith enabling various fabric thicknesses to be gripped and the upper member has a separate stud onto which the hole of an identification card or strap holding an identification card can be pressed.

19 Claims, 3 Drawing Sheets

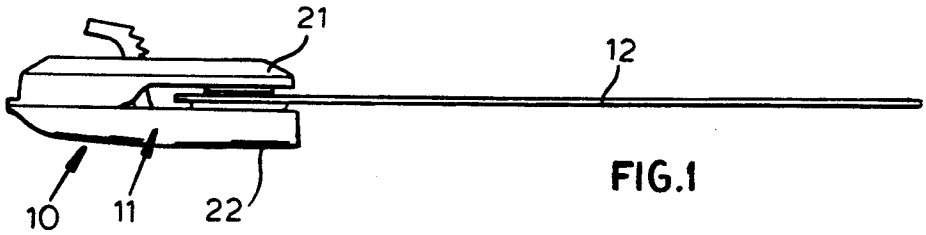
FIG.1
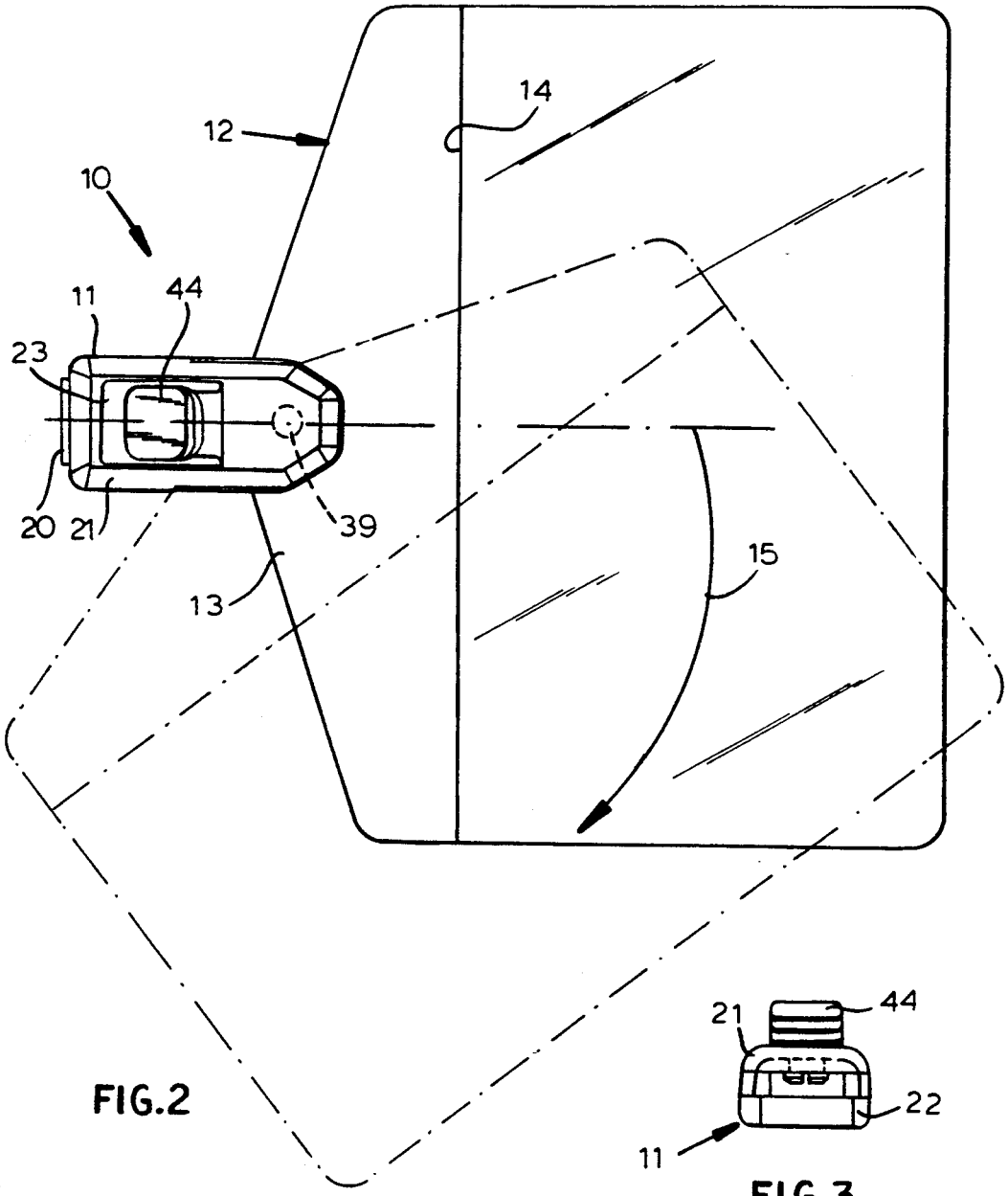
FIG.2
FIG.3

POCKET CLIP FOR CARD CASES, IDENTIFICATION BADGES AND THE LIKE

FIELD OF THE INVENTION

My present invention relates to a clip adapted to be rapidly engaged on a garment, e.g. on a lapel, pocket or band, for use in releasably mounting a card case or holder, an identification badge, a warning badge for detecting radio activity or the like to an individual. Naturally, such a clip can be used for applying other indicia to garments on hangers or display racks or the like.

BACKGROUND OF THE INVENTION

For the purposes of this description, the reference to a clip capable of being removably attached to a pocket, lapel or other flap of a garment of a wearer, to retain a card holder, badge or the like, will be understood to include other uses of the clip without limitation, including the use of the clip itself as an indication of information, for example depending upon its color, or to retain indicia of other types on garments, fabrics, webs and other material in a removable and readily detachable manner.

A clip of the type referred to should be easily manipulatable by the user, and, especially manipulatable with one hand, should be readily applicable to the pocket, lapel or the like, should be nondamaging to the garment to which it is applied, regardless of the force used in applying it and the quality or nature of the garment fabric (e.g. fine silk) and should be capable of retaining the identification item or article reliably on the garment so that it does not fall off even with vigorous agitation and casual contact in crowds or the like.

The problem of attaching an identification badge or like identification article to the garment of a wearer is substantial, considering the fact that many millions of identification badges are worn yearly, the badges are frequently intended to be disposable and the wearer may have physical disabilities, e.g. may be arthritic, or may otherwise be incapable of attaching an identification badge in a convenient manner.

For example, badges which include safety pins require considerable dexterity for use and always damage the garment, if only because the garment must be pierced.

Prior art clip devices have also damaged garments, have been assembled from a number of parts so that they are expensive and frequently are not disposable as a practical matter and may require a number of steps to attach them and even two hands to remove them.

Another problem encountered with prior art clips for the purpose described is that the garment or fabric to which the clip is to be attached may range in thickness or weight widely, to the point that a clip designed for engagement with heavy suit materials will not adequately be retained on fine silk, lace or chiffon.

Conversely, a clip which is capable or being secured to fine silk without damaging it, may not be applicable to heavier materials like those of men's suit coats.

OBJECTS OF THE INVENTION

It is, therefore, the principal object of the present invention to provide an improved clip for the attachment of a card holder or other identification medium to the garment of a wearer, whereby drawbacks of earlier systems are obviated.

Another object of the invention is to provide an identification badge assembly, including the improved clip, which can be used without damage to engage materials having a wide range of thicknesses, which can be manipulated easily with one hand for applying the clip and removing it, which can ensure firm retention of the identification medium against all effects and influences which may tend to cause loss of the badge and use.

It is still another object of the invention to provide a clip, identification unit or the like which is composed of fewer pieces than earlier clips, can be used in a far simpler manner than earlier clips and can be fabricated at low cost.

SUMMARY OF THE INVENTION

These objects and others which will become apparent hereinafter are attained, in accordance with the present invention, with a clip composed of two halves molded unitarily with one another and joined by an integrally molded plastic hinge to form a clam-shell like structure, one part of which is provided with a throughgoing opening at a lug proximal to its hinge or rear end while the other part in alignment with this opening is formed with an upwardly-extending tongue having a plurality of teeth engageable with an edge of this opening as the two parts are closed on one another and the tongue projects through this opening to form a ratchet enabling the clip to be closed upon fabrics of different weight and to be retained thereon regardless of the fabric thickness.

According to a feature of the invention at the front end of the part provided with the opening, i.e. the top part or member, a retaining stud is provided which can engage in a hole of a card holder or strap to which a card holder or identification card is affixed. The stud can, according to the invention, be tubular so that it can engage over and be spread by a pin on the front end of the inner or lower part carrying the tongue.

The stud can be split so as to have its parts inwardly deflectable as it is thrust into the hole or the hole is thrust over the stud and the inwardly deflectable members of the stud can have outwardly projecting portions at its rim to engage over the boundary of the hole and retain the strip or card holder on the stud.

According to another feature of the invention, the pin itself is mounted on a resilient tongue or lug which is partly separated from the lower member by a cut-out, gap or slot so that this resilient tongue can deflect at its junction with a cross-piece of the lower member which may be reinforced and made more rigid by a bar which extends across the lower member at the resilient junction of the toothed tongue therewith.

An apron or flange may extend around the perimeter of the lower member away from the upper member to reinforce the lower member around the tongues.

According to a feature of the invention, moreover, the toothed tongue can have a pressing flange at its upper end which lies wholly inwardly of the aforementioned opening so that, when this flange is pressed downwardly and the lower portion of the clip is held, the latter tongue will release the edge of the upper member of the clip and the upper member will spring away from the lower member by resiliency at the hinge. The aforementioned flange prevents immobilization of the tongue during this release action.

According to another aspect of the invention, the strap has a unique construction with a stud itself provided with three angularly-equispaced inwardly deflectable posts which can be engaged by a hole of the strap having three inwardly projecting protuberances so that the end of the strap provided with the hole can be looped over the stud and locked thereon.

The clip of the invention eliminates toggle-type structures of greater complexity and numbers of parts and can be injection-molded in one piece from comparatively inexpensive materials, like polypropylene.

Thus a clip for holding an identification medium of a fabric can comprise:

an upper and a lower elongated clip members formed unitarily with one another of a plastic and joined at rear ends of the members by a plastic film hinge, the members being foldable about the hinge in a clamshell orientation and having substantially the same outline;

the upper member being formed proximal to the hinge with a window having a front edge;

the lower member having an upwardly extending resilient tongue projecting through the window and formed with a multiplicity of teeth selectively engageable with the front edge to retain the clip clamped upon a fabric independently of thickness thereof upon the members being squeezed together on the fabric;

the tongue being formed with a tab fully within an outline of the window above the upper member and depressible to release the tongue from the edge and spread the members apart and release the clip from the fabric;

the upper member being formed forwardly of the window with a resilient stud engageable in a hole of the medium and extending toward the lower member; and the lower member being provided with a pin projecting toward the upper member and aligned with the stud.

The invention also, therefore, includes a clip-on identification assembly consisting of this clip and the identification medium having a hole fitted over the stud.

The identification medium itself may include a card holder which can be provided with this hole and fitted directly onto the stud or can be connected to the clip by a strap provided with the aforementioned post and aperture fitting onto this post.

In more general terms, therefore, a clip-on identification assembly can comprise:

a clip for releasable engagement with a fabric and having an upper and a lower elongated clip members formed unitarily with one another of a plastic and joined at rear ends of the members by a plastic film hinge, the members being foldable about the hinge in a clamshell orientation and having substantially the same outline, means for locking the members releasably together, and a stud on the upper member; and a strap formed with a hole fitted onto the stud, the strap being adapted to be bent around a portion of a card holder for receiving an identification card.

BRIEF DESCRIPTION OF THE DRAWING

The above and other objects, features and advantages of the present invention will become more readily apparent from the following description, reference being made to the accompanying drawing in which:

FIG. 1 is a side elevational view of a clip according to the invention shown engaged with a card holder.

FIG. 2 is a plan view of the closed clip and the associated card holder;

FIG. 3 is a front view of the clip;

SPECIFIC DESCRIPTION

Figure 4:
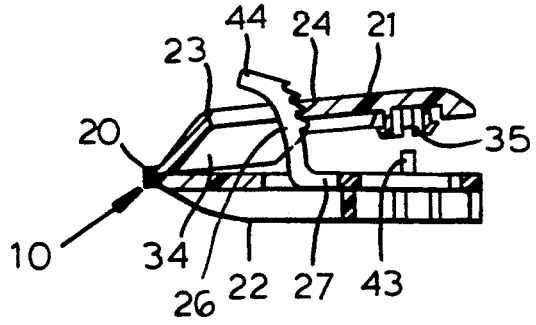
FIG. 4 is a longitudinal section through the clip prior to being close and without a card holder.
Figure 5:
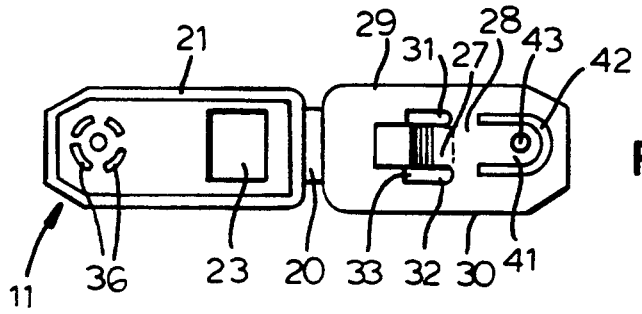
FIG. 5 is a plan view of the interior of the clip with the two parts thereof spread apart.
Figure 6:
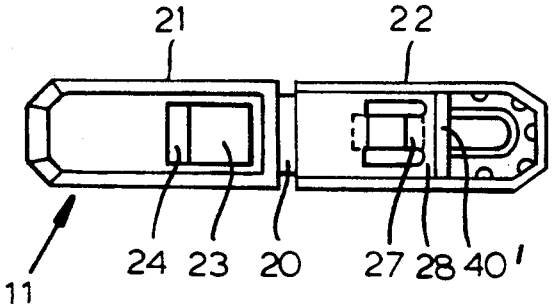
FIG. 6 is a view similar to FIG. 5 but of the underside of the clip.
Figure 7:
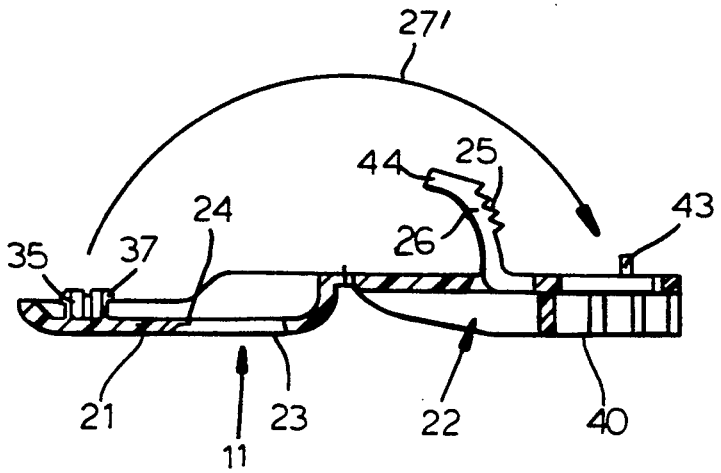
FIG. 7 is a longitudinal section through the clip, again with the two parts spread fully apart.

The identification assembly 10 shown in FIGS. 1 and 2 comprises a clip 11 and a card holder 12 which, as will be apparent from FIG. 2, can include a tab 13 engaged by the clip 11 and formed with a pocket 14 into which an identification card can be inserted. The holder 12 can be composed of a transparent material and can swivel on the clip 11 as represented by the arrow 15 about a stud which will be described in greater detail.

Figure 11:
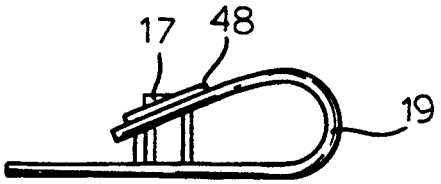
FIG. 11 is a side elevational view of the strap illustrated in its folded-back position.

Alternatively, a strap 16 may be inserted into the clip 11 and can have a post 17 and an aperture 18 adapted to be bent as shown in FIG. 11 back over the post to form a loop 19 which can engage in a slit in a card holder similar to that shown at 12 in FIGS. 1 and 2.

Returning to FIGS. 1–7, all of which show the clip 11 in various positions or orientations, it will be apparent that the clip comprises an upper clip member 21 and a lower clip member 22, both of which are elongated and which are molded integrally with one another via a plastic film hinge 20 out of polypropylene, for example.

The upper member 21 is formed with a window 23 of rectangular outline and a front edge 24 of reduced thickness. This front edge effectively forms a blade engageable in teeth 25 provided on the front face of a tongue 26 which projects upwardly through the window 23 when the two members are folded about the hinge 20 as represented by the arrow 27' in FIG. 7 to provide a clamshell orientation (see especially FIG. 4).

The tongue 26 is connected by a foot 27 with a crosspiece 28 of member 22 connecting opposite longitudinal sides 29 and 30 thereof. The foot 27 is delimited by cut-outs 31 and 32 forming part of an opening 33 in the lower member 32.

Figure 8:
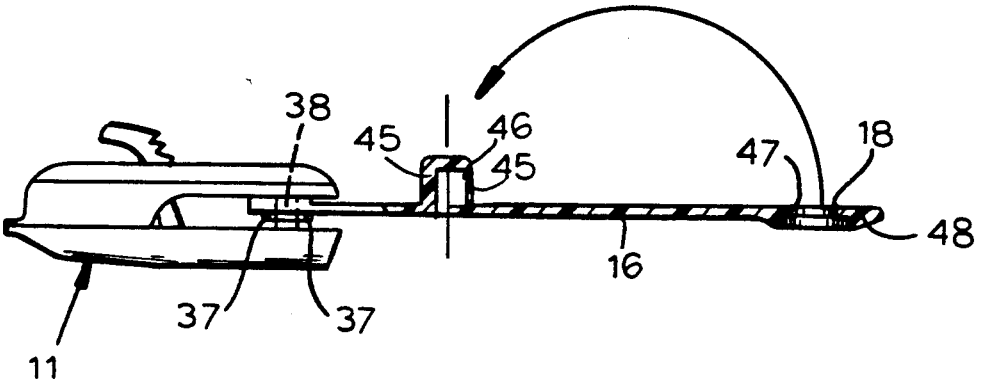
FIG. 8 is a side elevational view of the clip showing a strap affixed thereto but in partial longitudinal section.
Figure 9:
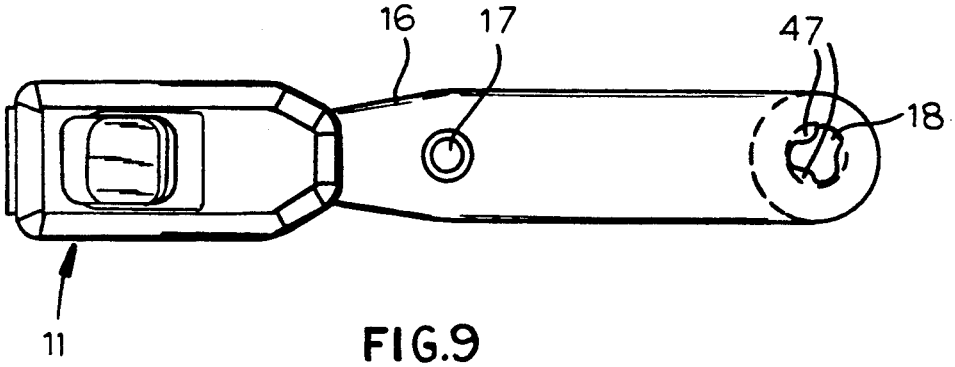
FIG. 9 is a top view of the closed clip showing the open strap.
Figure 10:
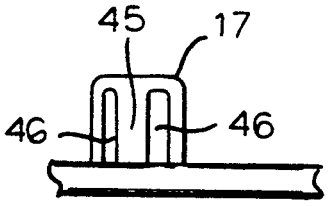
FIG. 10 is a detail view drawn to a much larger scale of the stud on the strap in elevation.

The upper member 21 is formed with an apron 34 substantially all around its perimeter and with a stud 35 which extends toward the member 22. As will be apparent from FIGS. 4, 5 and 7, the stud 35 is split so as to have segments 36, each of which has an outwardly turned projection 37 adapted to reach over a hole formed in the card holder 12 or the strap 16 as shown in FIG. 8, for example, where the projections 37 are shown to underlie the strap and retain the latter on the stud. The hole in the strap 16 has been represented at 38 in this Figure. It is shown at 39 for the card holder 12 in FIG. 2.

It can be seen further that the lower member 22 is provided with an outwardly-extending apron 40 which runs around the perimeter of this member as a reinforcement and also serves as a finger support so that, when the clip is engaged between the fingers of a user, the finger, e.g. the thumb, pressed against the underside of the clip will not interfere with depression of the tongue 26.

A crossbar 40' along the underside bridges the longitudinal sides of this apron to further stiffen the crosspiece 28 and separate the action of the tongue 26 from the resilient displacement of a lug 41 delimited by a cutout 42 from the remainder of member 22. The resilient lug 41 enables a pin 43 thereon, aligned with the stud 35 and engageable in the interior of the stud if desired, to be deflected by the fabric onto which the clip is pressed.

The tongue 26 has a tab 44 which lies wholly within the outline of the window 23 (see FIG. 2, for example) so that edges of the window will not interfere with depression of the lug.

In use, the card holder is anchored directly to the lug 35 or to a strap 16 fitted onto the lug 35 and the clip in the position shown in FIG. 4 is placed over a pocket or lapel so that the fabric lies between the pin 43 and the stud 35.

The members 21 and 22 are pressed together with the edge 24 ratcheting along the teeth 25 until the clip is clearly fitted. This operation can be performed with one hand with ease.

Should it be necessary or desirable to remove the clip, the user need only press the tab 44 downwardly with the index finger while supporting the member 22 with the thumb to release member 21, thereby enabling that member to spring upwardly and free the clip from the fabric.

As can be seen from FIGS. 8–11, the strap 16 can be formed with the post 17 which can have three uprights 45 separated by three openings 46 into which projections 47 of the aperture 18 can engage when the aperture 18 is bent over onto the post 17 as shown in FIG. 11. The aperture 18 may be reinforced by a circular enlargement 48 if desired. The strap 16 may be also molded from a plastic material such as a polyalkylene.

I claim:

1. A clip in combination with an identification medium having a hole for fastening to a fabric, said clip comprising:

upper and lower elongated clip members formed unitarily with one another of a plastic and joined at rear ends of said members by a plastic film hinge, said members being foldable about said hinge in a clamshell orientation and having substantially the same outline;

said upper member being formed proximal to said hinge with a window having a front edge;

said lower member having an upwardly extending resilient tongue projecting through said window and formed with a multiplicity of teeth selectively engageable with said front edge for retaining said clip clamped upon a fabric independently of thickness thereof upon said members being squeezed together on said fabric;

said tongue being formed with a tab fully within an outline of said window above said upper member and depressible to release said tongue from said edge and spread said members apart and release the clip from the fabric;

said upper member being formed forwardly of said window with a resilient stud engageable in said hole of said medium and extending toward said lower member; and said lower member being provided with a pin projecting toward said upper member and aligned with said stud and with a crosspiece bridging opposite longitudinal sides thereof, said tongue having a foot extending from said crosspiece into an opening formed in said lower member.

2. The clip defined in claim 1 wherein said crosspiece has a resilient lug projecting forwardly therefrom and delimited by a slit from said sides of said lower member, said pin being formed on said lug.

3. The clip defined in claim 2 wherein said lower member has on an underside thereof and is formed with a perimeter, an apron extending around at least a part of the perimeter of said lower member, and a crossbar connecting said opposite sides thereof, fixed to said apron and located below said crosspiece.

4. The clip defined in claim 3 wherein said upper member has an apron extending toward said lower member and running around a perimeter of said upper member.

5. The clip defined in claim 4 wherein said pin is circular.

6. The clip defined in claim 1 wherein said stud is split and has a plurality of segments each formed with a free end overhanging the information medium fitted over said stud.

7. The clip defined in claim 6 wherein said pin fits into said stud between said segments.

8. The clip defined in claim 1 wherein said stud is hollow and said pin fits into said stud.

9. The clip defined in claim 1 wherein said upper member has a thinned region along said edge.

10. A clip-on identification assembly, comprising: a clip for releasable engagement with a fabric, said clip upper and lower elongated clip members formed unitarily with one another of a plastic and joined at rear ends of said members by a plastic film hinge, said members being foldable about said hinge in a clamshell orientation and having substantially the same outline, said upper member being formed proximal to said hinge with a window having a front edge, said lower member having an upwardly extending resilient tongue projecting through said window and formed with a multiplicity of teeth selectively engageable with said front edge for retaining said clip clamped upon a fabric independently of thickness thereof upon said members being squeezed together on said fabric, said tongue being formed with a tab fully within an outline of said window above said upper member and depressible to release said tongue from said edge and spread said members apart and release the clip from the fabric, said upper member being formed forwardly of said window with a resilient stud extending toward said lower member, and said lower member being provided with a pin projecting toward said upper member and aligned with said stud; and an identification medium having a hole fitted over said stud and retained thereon.

11. The clip-on identification assembly defined in claim 10 wherein said medium is a card holder adapted to receive an identification card.

12. The clip-on identification assembly defined in claim 11 wherein said card holder has said hole and is fitted directly onto said stud.

13. The clip-on identification assembly defined in claim 10 wherein said medium is a strap formed with said hole and adapted to be bent around a card holder for receiving an identification card.

14. The clip-on identification assembly defined in claim 13 wherein said strap is provided with:

a post formed with a plurality of uprights and spaces between said uprights, and an aperture formed with a number of inward projections equal to a number of said spaces and receivable therein upon fitting of said aperture onto the post of said strap.

15. The clip-on identification assembly defined in claim 10 wherein said tongue has a foot resiliently extending from a crosspiece of said lower member bridging opposite longitudinal sides thereof into an opening formed in said lower member, said crosspiece has a resilient lug projecting forwardly therefrom and delimited by a slit from said sides of said lower member, said pin being formed on said lug, said lower member has on an underside thereof, an apron extending partially around a perimeter of said lower member, and a bar connecting said opposite sides thereof, fixed to said apron and located below said crosspiece.

16. The clip-on identification assembly defined in claim 15 wherein said upper member has an apron extending toward said lower member and running around a perimeter of said upper member, said pin is circular, said stud is split and has a plurality of segments each formed with a free end overhanging the information medium fitted over said stud, and said pin fits into said stud between said segments.

17. The clip-on identification assembly defined in claim 15 wherein said stud is hollow and said pin fits into said stud, and said upper member has a thinned region along said edge.

18. A clip-on identification assembly, comprising:

a clip for releasable engagement with a fabric and having upper and lower elongated clip members formed unitarily with one another of a plastic and joined at rear ends of said members by a plastic film hinge, said members being foldable about said hinge in a clamshell orientation and having substantially the same outline, means for locking said members releasably together, and a stud on said upper member; and a strap formed with a hole fitted onto said stud and adapted to be bent around a portion of a card holder for receiving an identification card, said strap being provided with a post formed with a plurality of uprights and spaces between said uprights and with an aperture formed with a number of inward projections equal to a number of said spaces and receivable therein upon fitting of said aperture onto the post of said strap.

19. A clip in combination with an identification medium having a hole for fastening to a fabric, said clip comprising:

upper and lower elongated clip members formed unitarily with one another of a plastic and joined at rear ends of said members by a plastic film hinge, said members being foldable about said hinge in a clamshell orientation and having substantially the same outline;

said upper member being formed proximal to said hinge with a window having a front edge;

said lower member being provided with:

an upwardly extending resilient tongue projecting through said window and formed with a multiplicity of teeth selectively engageable with said front edge for retaining said clip clamped upon a fabric, and a resilient lug formed forwardly of said tongue and operatively engaging said upper member while being resiliently deflected by said fabric when said members are squeezed together on said fabric, so that said clip retains clamped on said fabric independently of thickness thereof;

said tongue being formed with a tab fully within an outline of said window above said upper member and depressible to release said tongue from said edge and spread said members apart and release the clip from the fabric;

said upper member being formed forwardly of said window with a resilient stud engageable in said hole of said medium and extending toward said lower member; and said lug being provided with a pin projecting toward said upper member and aligned with said stud.

* * * * *